US008392182B2

(12) United States Patent
Vos

(10) Patent No.: US 8,392,182 B2
(45) **Date of Patent: *Mar. 5, 2013**

(54) SPEECH CODING

(75) Inventor: Koen Bernard Vos, San Francisco, CA (US)

(73) Assignee: Skype, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 13/414,442

(22) Filed: Mar. 7, 2012

(65) Prior Publication Data

US 2012/0166189 A1 Jun. 28, 2012

Related U.S. Application Data

(62) Division of application No. 12/455,761, filed on Jun. 5, 2009.

(30) Foreign Application Priority Data

Jan. 6, 2009 (GB) ..... 0900136.3

(51) Int. Cl.
*G10L 19/00* (2006.01)

(52) U.S. Cl. ..... 704/230; 704/200; 704/201; 704/219; 704/223; 704/229

(58) Field of Classification Search ..... 704/230, 704/200, 229, 219, 201, 223
See application file for complete search history.

(56) References Cited

U.S. PATENT DOCUMENTS

| | | | | |
|---|---|---|---|---|
| 5,884,269 | A | 3/1999 | Cellier et al. | |
| 6,058,213 | A * | 5/2000 | Cho | 382/239 |
| 6,377,930 | B1 * | 4/2002 | Chen et al. | 704/503 |
| 6,650,255 | B2 | 11/2003 | Bruekers et al. | |
| 6,735,339 | B1 * | 5/2004 | Ubale | 382/232 |
| 8,301,441 | B2 | 10/2012 | Vos | |
| 2003/0012279 | A1 | 1/2003 | Chaddha | |
| 2003/0072366 | A1 * | 4/2003 | Bartolucci et al. | 375/240.04 |
| 2007/0016418 | A1 * | 1/2007 | Mehrotra et al. | 704/240 |
| 2010/0174531 | A1 | 7/2010 | Bernard Vos | |

FOREIGN PATENT DOCUMENTS

| | | |
|---|---|---|
| CN | 102341849 | 2/2012 |
| EP | 1445 956 A1 | 8/2004 |
| GB | 2466666 | 7/2010 |
| WO | WO-2010079169 | 7/2010 |

OTHER PUBLICATIONS

"Non-Final Office Action", U.S. Appl. No. 12/455,761, (Mar. 7, 2012), 11 pages.

"Notice of Allowance", U.S. Appl. No. 12/455,761, (Jun. 22, 2012), 10 pages.

(Continued)

*Primary Examiner* — Qi Han

(74) *Attorney, Agent, or Firm* — Wolfe-SBMC

(57) ABSTRACT

A method of encoding one or more parent blocks of values, the number of values being the length of each block, the method comprising for each parent block:

(a) determining a first sum of values in the parent block;

(b) splitting the parent block into smaller subblocks;

(c) for at least one of the subblocks, determining a second sum of the values in the subblock, selecting a likelihood table from the plurality of likelihood tables based on said first sum of values in the parent block and encoding the second sum using the likelihood table;

(d) designating each subblock a parent block;

(e) carrying out steps (a), (b), (c) and (d) until at least one parent block reaches a predetermined condition.

16 Claims, 6 Drawing Sheets

OTHER PUBLICATIONS

"Restriction Requirement", U.S. Appl. No. 12/455,761, (Jan. 9, 2012), 6 pages.

International Search Report for GB0900136.3, date of mailing Apr. 29, 2009.

Cadel, D., et al., "Pyramid Vector Coding for High Quality Audio Compression," *IEEE International Conference on Munich*, vol. 1, 21, pp. 343-346 (1997).

Notification of Transmittal of the International Search Report and the Written Opinion of the International Searching Authority, or the Declaration for Application No. PCT/EP2010/050059, dated Apr. 19, 2010.

"Examination Report", GB Application No. 0900136.3, (Sep. 17, 2012), 3 pages.

* cited by examiner

-BACKGROUND SUBJECT MATTER-

-BACKGROUND SUBJECT MATTER-

SPEECH CODING

RELATED APPLICATIONS

This application is a Divisional of U.S. application Ser. No. 12/455,761, filed on Jun. 5, 2009, which claims priority under 35 U.S.C. §119 or 365 to Great Britain Application No. 0900136.3, filed Jan. 6, 2009. The entire teachings of the above applications are incorporated herein by reference.

FIELD OF THE INVENTION

The present invention relates to the encoding of speech for transmission over a transmission medium, such as by means of an electronic signal over a wired connection or electromagnetic signal over a wireless connection.

BACKGROUND

A source-filter model of speech is illustrated schematically in FIG. 1*a*. As shown, speech can be modelled as comprising a signal from a source 102 passed through a time-varying filter 104. The source signal represents the immediate vibration of the vocal chords, and the filter represents the acoustic effect of the vocal tract formed by the shape of the throat, mouth and tongue. The effect of the filter is to alter the frequency profile of the source signal so as to emphasise or diminish certain frequencies. Instead of trying to directly represent an actual waveform, speech encoding works by representing the speech using parameters of a source-filter model.

As illustrated schematically in FIG. 1*b*, the encoded signal will be divided into a plurality of frames 106, with each frame comprising a plurality of subframes 108. For example, speech may be sampled at 16 kHz and processed in frames of 20 ms, with some of the processing done in subframes of 5 ms (four subframes per frame). Each frame comprises a flag 107 by which it is classed according to its respective type. Each frame is thus classed at least as either "voiced" or "unvoiced", and unvoiced frames are encoded differently than voiced frames. Each subframe 108 then comprises a set of parameters of the source-filter model representative of the sound of the speech in that subframe.

For voiced sounds (e.g. vowel sounds), the source signal has a degree of long-term periodicity corresponding to the perceived pitch of the voice. In that case, the source signal can be modelled as comprising a quasi-periodic signal, with each period corresponding to a respective "pitch pulse" comprising a series of peaks of differing amplitudes. The source signal is said to be "quasi" periodic in that on a timescale of at least one subframe it can be taken to have a single, meaningful period which is approximately constant; but over many subframes or frames then the period and form of the signal may change. The approximated period at any given point may be referred to as the pitch lag. An example of a modelled source signal 202 is shown schematically in FIG. 2*a* with a gradually varying period $P_1$, $P_2$, $P_3$, etc., each comprising a pitch pulse of four peaks which may vary gradually in form and amplitude from one period to the next.

According to many speech coding algorithms such as those using Linear Predictive Coding (LPC), a short-term filter is used to separate out the speech signal into two separate components: (i) a signal representative of the effect of the time-varying filter 104; and (ii) the remaining signal with the effect of the filter 104 removed, which is representative of the source signal. The signal representative of the effect of the filter 104 may be referred to as the spectral envelope signal, and typically comprises a series of sets of LPC parameters describing the spectral envelope at each stage. FIG. 2*b* shows a schematic example of a sequence of spectral envelopes $\mathbf{204}_1$, $\mathbf{204}_2$, $\mathbf{204}_3$, etc. varying over time. Once the varying spectral envelope is removed, the remaining signal representative of the source alone may be referred to as the LPC residual signal, as shown schematically in FIG. 2*a*. The short-term filter works by removing short-term correlations (i.e. short term compared to the pitch period), leading to an LPC residual with less energy than the speech signal.

The spectral envelope signal and the source signal are each encoded separately for transmission. In the illustrated example, each subframe 106 would contain: (i) a set of parameters representing the spectral envelope 204; and (ii) an LPC residual signal representing the source signal 202 with the effect of the short-term correlations removed.

To improve the encoding of the source signal, its periodicity may be exploited. To do this, a long-term prediction (LTP) analysis is used to determine the correlation of the LPC residual signal with itself from one period to the next, i.e. the correlation between the LPC residual signal at the current time and the LPC residual signal after one period at the current pitch lag (correlation being a statistical measure of a degree of relationship between groups of data, in this case the degree of repetition between portions of a signal). In this context the source signal can be said to be "quasi" periodic in that on a timescale of at least one correlation calculation it can be taken to have a meaningful period which is approximately (but not exactly) constant; but over many such calculations then the period and form of the source signal may change more significantly. A set of parameters derived from this correlation are determined to at least partially represent the source signal for each subframe. The set of parameters for each subframe is typically a set of coefficients of a series, which form a respective vector.

The effect of this inter-period correlation is then removed from the LPC residual, leaving an LTP residual signal representing the source signal with the effect of the correlation between pitch periods removed. To represent the source signal, the LTP vectors and LTP residual signal are encoded separately for transmission.

The sets of LPC parameters, the LTP vectors and the LTP residual signal are each quantised prior to transmission (quantisation being the process of converting a continuous range of values into a set of discrete values, or a larger approximately continuous set of discrete values into a smaller set of discrete values). The advantage of separating out the LPC residual signal into the LTP vectors and LTP residual signal is that the LTP residual typically has a lower energy than the LPC residual, and so requires fewer bits to quantize.

So in the illustrated example, each subframe 106 would comprise: (i) a quantised set of LPC parameters representing the spectral envelope, (ii)(a) a quantised LTP vector related to the correlation between pitch periods in the source signal, and (ii)(b) a quantised LTP residual signal representative of the source signal with the effects of this inter-period correlation removed.

Prior to transmission, the quantized values are encoded.

Pyramid vector coding is a lossless enumeration coding technique that provides efficient encoding for integer values with a Laplacian probability distribution, where the probability of an integer value decreases exponentially with its absolute value. Pyramid vector coding is commonly used in transform coding and sub band coding of still and moving images and in audio transform coding. For these coding methods, the transform or sub band coefficients have approximately a Laplacian probably distribution, making Pyramid vector coding an efficient method.

Pyramid vector coding operates on a block of L quantization indices q(n), typically produced by scalar, lattice or trellis quantizing transform coefficients. In one implementation of Pyramid vector coding, the first step is to convert the block of quantization indices into a block of sign values s(n) and a block of absolute values u(n). The sign values corresponding to nonzero quantization indices are encoded with a simple two-level entropy coder. The absolute values are summed together to produce the radius K $$K = \sum_{n=1}^{L} u(n),$$

which is indicated to the decoder separately.

Pyramid vector coding represents the block of absolute values u(n) as a distribution of K unit pulses over the L samples. The number of possible such distributions is denoted by N(L,K) and can be computed recursively using $$N(l, k) = N(l-1, k) + N(l, k-1) \text{ where } k = \sum_{n=1}^{l} u(n)$$

with $$N(l, 0) = 1$$

and $$N(1, k) = 1.$$

The encoding process computes an index b for one of the N(L,K) distributions, according to the following pseudo code.

```
Init:   b = 0;
        k = K;
        l = L;
for n = 1...L
        b = b + N(l, k) − N(l, k − u(n));
        k = k − u(n);
        l = l − 1;
end
```

The results is an index b, with 0<=b<N(L,K). For efficiency reasons, the N(l,k) values are often stored in a ROM table of size $LK_{max}$ so that the recursive computation of N(l,k) is avoided.

The index b is decoded according to the pseudo code

```
Init:   k = K;
        l = L;
for n = 1...L
        u(n) = {the smallest integer value j such that
        N(l, k) − N(l, k − j) > b};
        b = b − N(l, k) + N(l, k − u(n));
        k = k − u(n);
        l = l − 1;
end
```

Every index corresponds to a unique distribution, and each distribution is coded with the same bitrate. In practice, the signal that is being encoded may not have a Laplacian probability distribution, and therefore each distribution is not equally likely. It has been observed that for optimum coding efficiency, some distributions should in that case be coded at a lower bitrate than others. In linear predictive speech coding for instance, a residual signal is encoded that has an approximately Gaussian probability distribution. Quantizing and encoding such a residual with an entropy coder for Laplacian probability distribution reduces coding efficiency, leading to a higher bitrate.

In another implementation of pyramid vector coding, the—possibly negative—quantization indices themselves are encoded, without first converting the quantization indices in sign values and absolute values.

Similar enumeration coding techniques exist such as Conditional Product Code, Factorial Packing and Conditional Product-Product Code, which all encode quantization indices efficiently if the quantization indices have a Laplacian probability distribution.

In predictive speech coding, sometimes the number of unit pulses per block is fixed. In that case, the radius K is not transmitted to the decoder. Alternatively, only a few values are allowed for the radius K, which reduces the bitrate for encoding the radius compared to a radius K that is unconstrained up to a maximum value $K_{max}$.

It is desirable to provide an improved encoding technique for encoding quantization values in speech transmission.

SUMMARY

According to one aspect of the present invention, there is provided a method of encoding one or more parent blocks of values, the number of values being the length of each block, the method comprising for each parent block: (a) determining a first sum of values in the parent block; (b) splitting the parent block into smaller subblocks; (c) for at least one of the subblocks, determining a second sum of the values in the subblock, selecting a likelihood table from the plurality of likelihood tables based on said first sum of values in the parent block and encoding the second sum using the likelihood table; (d) designating each subblock a parent block; (e) carrying out steps (a), (b), (c) and (d) until at least one parent block reaches a predetermined condition.

The step of obtaining the first sum of values of the parent block can be done by determining the sum of the values by summation, or by using a known value.

In addition to using the second sum to select the likelihood table, the length of the parent block can be used.

Another aspect of the invention provides an encoder for encoding a parent block of values, the number of values being the length of the block, the encoder comprising: means for splitting the parent block into smaller subblocks; means for summing the values in a subblock to generate a sum; a store holding likelihood tables, each likelihood table holding for each possible sum of values a probability associated with that sum; means for encoding the sum of the values in the subblock using a likelihood table located in the store; means for selecting from the store of likelihood tables a table based on the sum of the parent subblock, said encoding means being arranged to encode the sum of a subblock split from the parent block based on the selected likelihood table; and storage means for holding the result of said encoding.

A further aspect of the invention provides a method of decoding a bitstream representing one or more parent blocks of values, the number of values being the length of each block, the method comprising for each parent block: (a) obtaining a first sum of values in the parent block; (b) splitting the parent block into smaller subblocks; (c) for at least one of the subblocks, selecting a likelihood table from a plurality of stored tables based on the first sum of the values in the parent block, each likelihood table holding for each possible second sum of values in the subblock a probability associated with that sum, and decoding the bitstream based on the likelihood table to generate the second sum of values for the subblock; (d) designating each subblock as a parent block; (e) carrying out steps (a), (b), (c) and (d) until at least one parent block reaches a predetermined condition.

Another aspect of the invention provides a decoder for decoding a bitstream representing one or more parent blocks of values, the decoder comprising: means for obtaining a first sum of value in the parent block; means for splitting a parent block into smaller subblocks; means for selecting a likelihood table from a plurality of stored tables based on the first sum of the values in the parent block, each likelihood table holding for each possible second sum of values in the subblock a probability associated with that sum; and means for decoding the bitstream based on the likelihood table to generate the second sum of values for the subblock.

The invention also provides a system and method for encoding/decoding speech according to a source filter model, whereby speech is modelled to comprise a source signal filtered by a time varying filter. The method or system for encoding/decoding uses the encoding method defined above to encode a frame of excitation quantization indices, which can be recovered by a decoding method in accordance with embodiments of the invention.

The invention also provides a computer program product which when executed implements the steps of an encoding or decoding method in accordance with embodiments of the invention.

Embodiments of the invention are useful not only in encoding quantization values for speech, but in any situation where blocks of values are to be encoded.

BRIEF DESCRIPTION OF THE DRAWINGS

For a better understanding of the present invention and to show how it may be carried into effect, reference will now be made by way of example to the accompanying drawings in which.

DETAILED DESCRIPTION OF PREFERRED EMBODIMENTS

Linear predictive coding is a common technique in speech coding, whereby correlations between samples are exploited to improve coding efficiency. The output of an LPC synthesis filter is subtracted from a speech input signal to produce an LPC residual signal. The output of an LTP synthesis filter is subtracted from the LPC residual signal to create an LTP residual signal. The LTP residual signal is quantized to produce the excitation signal. The quantizer can be a scalar quantizer, a vector quantizer, an algebraic codebook quantizer, or any other suitable quantizer. The output of a long term predictor is added to the excitation signal, which creates an LPC excitation signal. The LPC excitation signal is input to a long-term predictor, which is, e.g. a strictly causal moving average (MA) filter controlled by the pitch lag and quantized LTP coefficients. The output of a short term predictor is added to the LPC excitation signal, which creates the quantized output signal. The quantized output signal is input to the short-term predictor, which is a strictly causal MA filter controlled by the quantized LPC coefficients.

Figure 3:
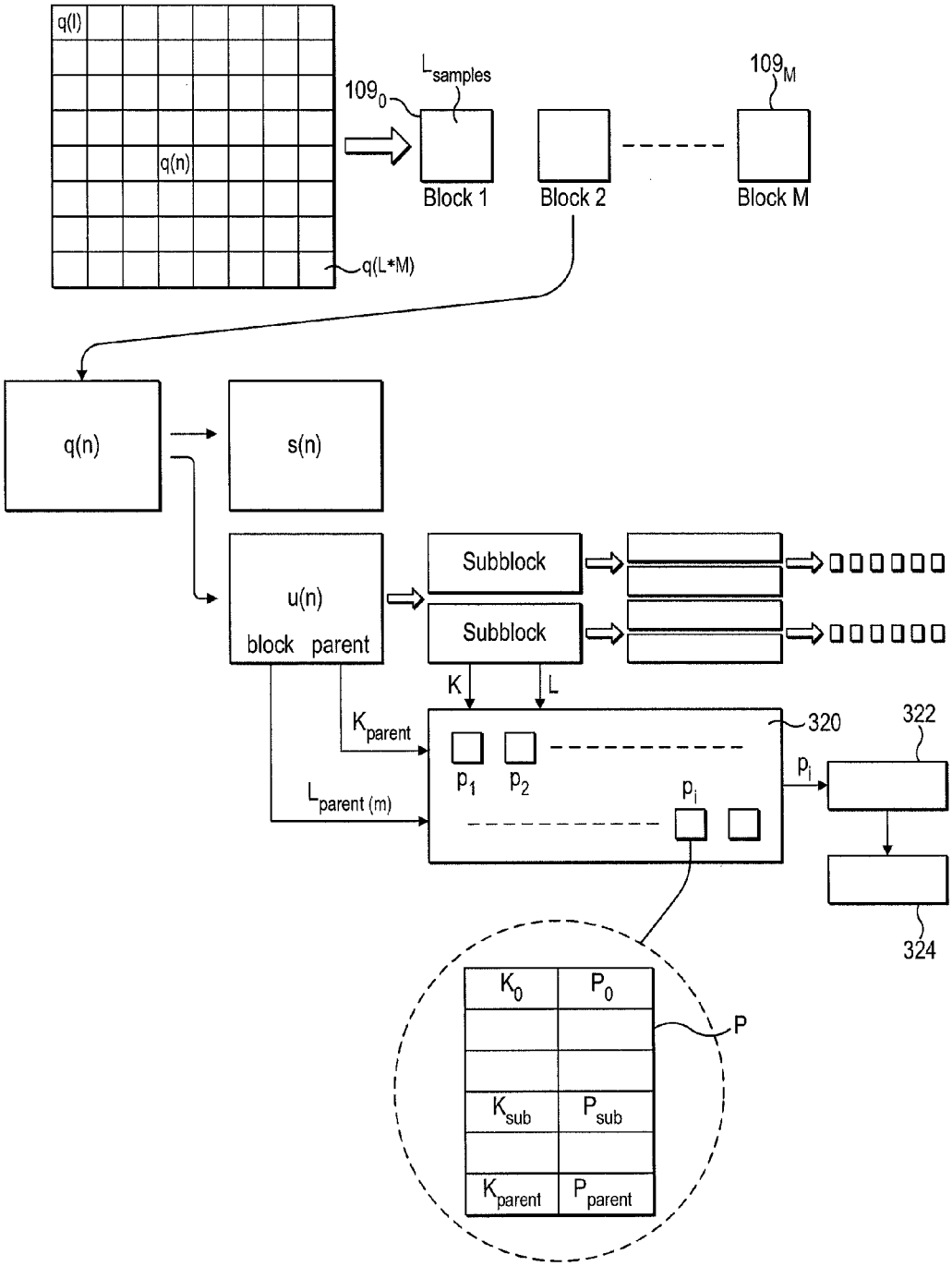
FIG. 3 is a schematic diagram representing an encoding technique using lookup tables.

The described embodiments illustrate a new encoding technique for the excitation quantization coefficients prior to transmission. The technique can also be used to encode other coefficients used in speech encoding, or in any situation where a block of values is to be encoded. Reference will now be made to FIG. 3 to explain the technique.

The signal of excitation quantization indices produced by the scalar quantizer is input to the arithmetic coder 518. Therein, an entropy coding takes place as described herein. The frame of L*M quantization indices is split into M blocks $\mathbf{109}_0 \ldots \mathbf{109}_M$ of L quantization indices each. Each block is sequentially and independently encoded. In the preferred embodiments L=16 and M=20.

For each block, the quantization indices q(n) are converted into signs s(n) and absolute values u(n). The absolute values are summed to produce a radius K $$K = \sum_{n=1}^{L} u(n).$$

If the radius K exceeds a maximum radius value of $K_{max}=20$, one or more absolute values u(n) are reduced such that the radius K becomes 20.

The radius K for each block is arithmetically encoded using a table of probability values located amongst a plurality of such tables stored in ROM 320. That is, a fixed probability table from the ROM 320 is passed to an arithmetic encoder 322 which carries out an arithmetic encoding process of the total sum K of absolute values based on the probability values in the selected probability table. Arithmetic encoding is known—see for example http://en.wikipedia.org/wiki/Arithmetic_coding. The details of the encoding are not important—what is important is the fact that the encoding is based on a probability table.

The result of the encoding is passed to a temporary store 324.

In some cases, the radius K is fixed, in which case there is no need to determine it, or encode it. The fixed value for the radius K would in that case be known at the encoder and decoder.

Next, the distribution of absolute values over the block is encoded by recursively splitting the parent block Block Parent in two equal-sized subblocks, starting with the block of 16 absolute values. For each split, a probability table P is selected from the plurality of probability tables $P_1 \ldots P_i$ based on the length $L_{parent}$ of the parent block and the sum of absolute values $k_{parent}$ in the parent block. Each probability table P stores the probability of having a sum of absolute values $k_{sub}$ in the block, for values of $k_{sub}$ from 0 to $k_{parent}$. The sum of absolute values in the first subblock is arithmetically encoded in encoder 322 using the selected probability table. The result updates the result of the encoding discussed above that was previously stored in the temporary store 324. This is carried out recursively, each time updating the stored result. Whenever a subblock is encountered for which the sum of absolute values is zero, that subblock is not split further and no further arithmetic encodings are done for that subblock. When the blocks have been split to this point, the final result is an encoded bitstream ready for transmission. FIG. 3 illustrates the method diagrammatically, where $P_1, P_2 \ldots P_i$ are probability tables, with $P_i$ denoting a selected table for each subblock after each split.

In pseudo code, this procedure can be expressed as

```
for m = 0...3
    Lparent = 2^(4−m);
    for i = 1 ... 2^m
        k_parent = Σ_{j=(i−1)L_parent}^{iL_parent−1} u(j);
        if k_parent > 0
            k_sub = Σ_{j=(i−1)L_parent}^{(2i−1)L_parent/2−1} u(j);
            Select a probability table P = Table{m}{kparent};
            Arithmetically encode k_sub using table P;
        end
    end
end
```

Since there are 4 different parent block lengths, 16, 8, 4, and 2, and the maximum radius Kmax is 20, a total of 4×20=80 probability tables P are stored.

For each nonzero absolute value in the block, the sign value s(n) is arithmetically encoded using a table of two probability values, one for a positive sign and one for a negative sign.

The probability tables can be created through an off-line training process. The training process runs an encoder over a training database of speech signals, and stores each occurrence of accessing a probability table element. After running the database, the frequencies of probability table element accesses are computed and normalized for each table to produce the probability values for the table elements.

Entropy coding based on a likelihood table for splitting a given number of unit pulses over two groups of samples is novel.

Recursive splitting of the parent blocks into pairs of subblocks, and arithmetic encoding of the numbers of unit pulses in each subblock given the number of unit pulses in the parent block allows for an efficient encoding of the distribution of unit pulses over the block of samples. For a block length of L samples, a total number of L−1 splits are required to uniquely indicate the number of unit pulses, i.e., amplitude value, for each sample in the block. For each split and each number of unit pulses in the parent block k, an arithmetic coding probability table P of size k+1 is used. For a maximum but otherwise unconstrained radius (total number of unit pulses in a block) of $K_{max}$, a total number of (L−1) $K_{max}$ tables is used, with an average number of $(K_{max}+1)/2$ elements per table. The total storage is thus approximately L $K_{max}^2/2$ elements. If the radius is fixed to a value K (e.g. k=20 as defined above), then the total storage is reduced to approximately L K/2. The probability tables P can be stored in ROM 320.

The encoding is efficient as long as two conditions are met. The first condition is that the actual probability distribution of the sample values match that of the arithmetic coding tables. This can be ensured by constructing the arithmetic coding tables through a training procedure as described above. Alternatively, it is possible to create the arithmetic coding tables by numerically integrating a certain probability distribution.

The second condition is that the sample values are statistically independent. The quantization of a whitened residual signal mostly ensures this, by removing correlations between the sample values.

If all samples in the block have identical probability distributions, then a reduction in table size is obtained by using the same arithmetic coding table for splits with the same subblock sizes. For instance, when the input block has a number $L=2^M$, then splitting parents blocks in two equal halves results in M different sizes for the subblock splits, and thus only $M=\log_2(L)$ arithmetic coding tables are required. In that case the total table size is approximately $\log_2(L)K_{max}^2/2$ elements. If the radius is fixed to a value K, then the total ROM storage is reduced to approximately $\mathrm{Log}_2(L)K/2$.

When coding at low bit rates, many of the quantization indices have a value of zero. This enables a computational optimization, where the recursive entropy encoding in the encoder and decoding in the decoder is stopped as soon as a subblock is encountered for which the sum of absolute values is zero, without further splitting that subblock. An alternative condition for stopping further splitting is that all subblocks have a length of one.

Figure 1A:
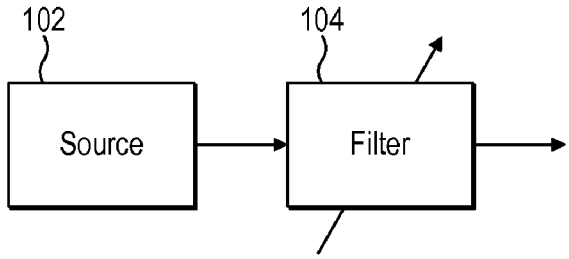
FIG. 1*a* is a schematic representation of a source-filter model of speech.
Figure 1B:
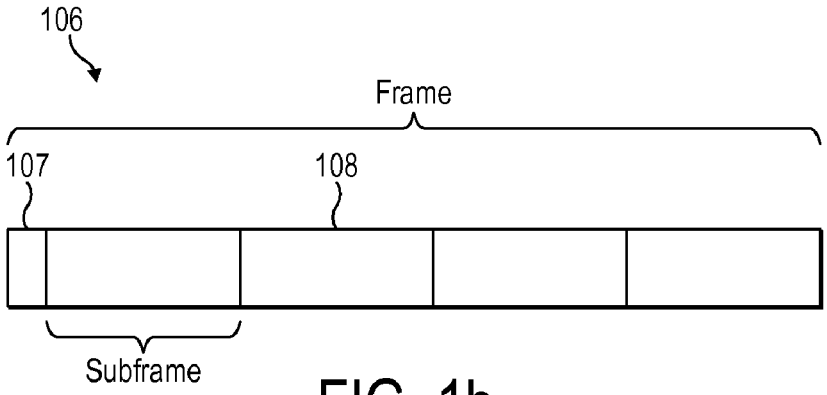
FIG. 1*b* is a schematic representation of a frame.
Figure 2A:
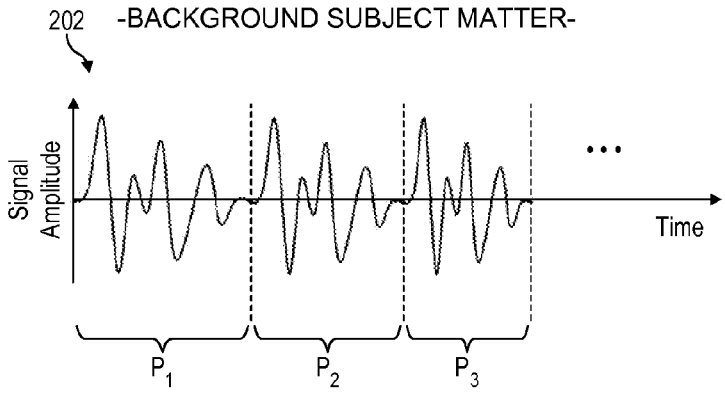
FIG. 2*a* is a schematic representation of a source signal.
Figure 2B:
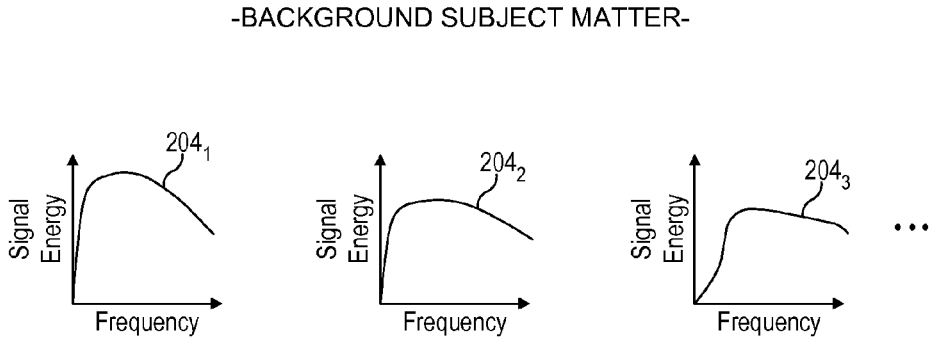
FIG. 2*b* is a schematic representation of variations in a spectral envelope.
Figure 4:
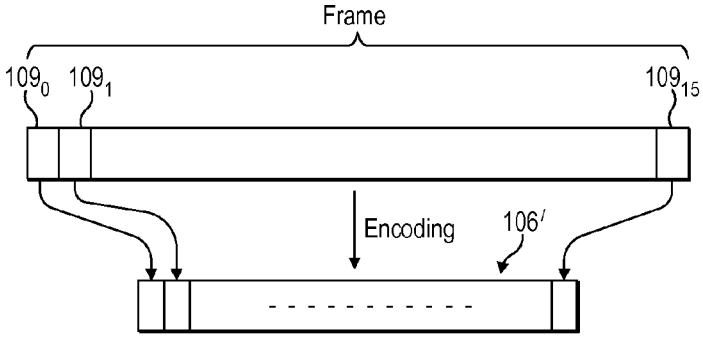
FIG. 4 is a schematic representation of a frame of quantization values prior to and after encoding.

FIG. 4 is a schematic representation of a frame of quantization indices prior to and after encoding. The frame is divided into 16 subframes $\mathbf{109}_0 \ldots \mathbf{109}_{15}$ for encoding as described above. The encoding process generates a bitstream 106' which has 16 encoded streams which represent the subframes 109 and which can be transmitted to a decoder.

Figure 5:
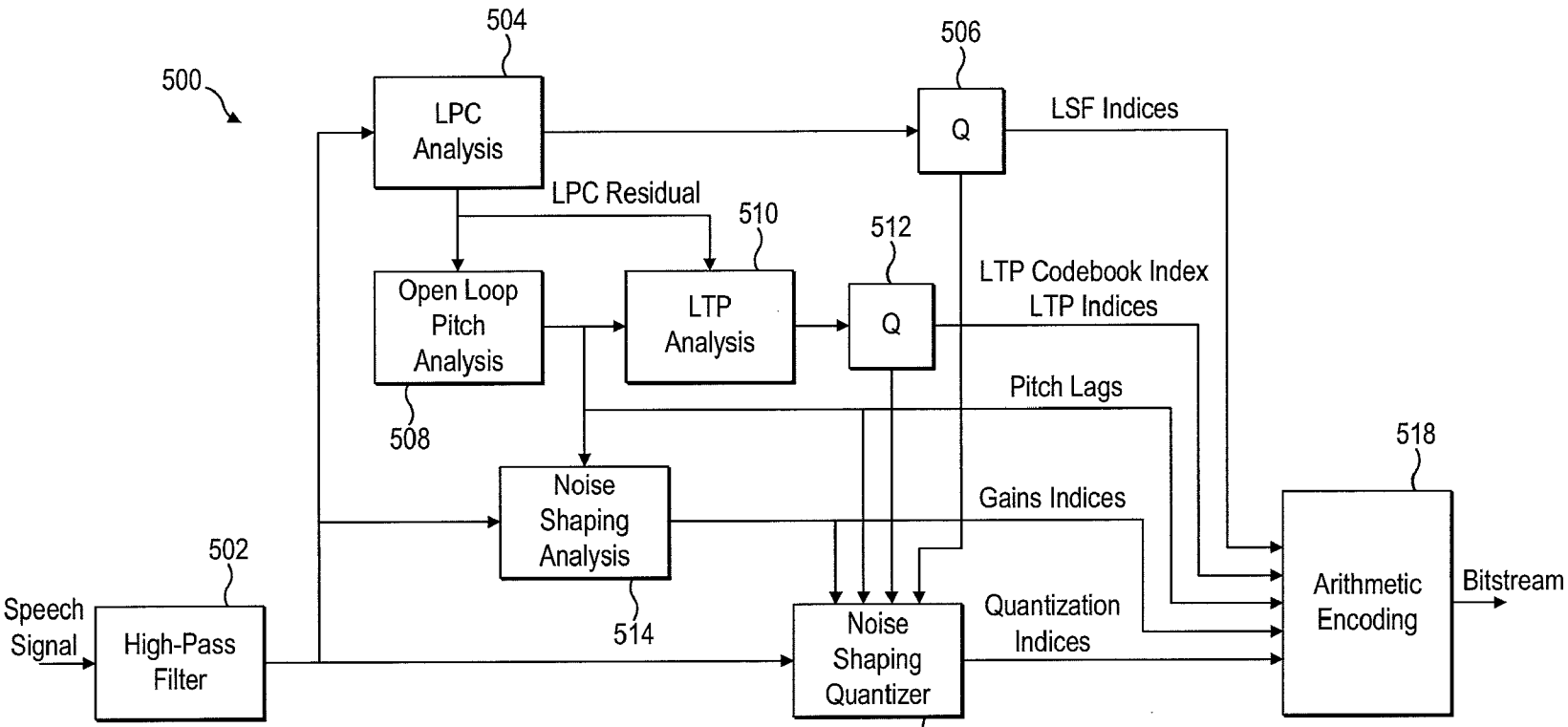
FIG. 5 is a schematic block diagram of an encoder.

An example of an encoder 500 for implementing the present invention is now described in relation to FIG. 5.

The encoder 500 comprises a high-pass filter 502, a linear predictive coding (LPC) analysis block 504, a first vector quantizer 506, an open-loop pitch analysis block 508, a long-term prediction (LTP) analysis block 510, a second vector quantizer 512, a noise shaping analysis block 514, a noise shaping quantizer 516, and an arithmetic encoding block 518. The high pass filter 502 has an input arranged to receive an input speech signal from an input device such as a microphone, and an output coupled to inputs of the LPC analysis block 504, noise shaping analysis block 514 and noise shaping quantizer 516. The LPC analysis block has an output coupled to an input of the first vector quantizer 506, and the first vector quantizer 506 has outputs coupled to inputs of the arithmetic encoding block 518 and noise shaping quantizer 516. The LPC analysis block 504 has outputs coupled to inputs of the open-loop pitch analysis block 508 and the LTP analysis block 510. The LTP analysis block 510 has an output coupled to an input of the second vector quantizer 512, and the second vector quantizer 512 has outputs coupled to inputs of the arithmetic encoding block 518 and noise shaping quantizer 516. The open-loop pitch analysis block 508 has outputs coupled to inputs of the LTP 510 analysis block 510 and the noise shaping analysis block 514. The noise shaping analysis block 514 has outputs coupled to inputs of the arithmetic encoding block 518 and the noise shaping quantizer 516. The noise shaping quantizer 516 has an output coupled to an input of the arithmetic encoding block 518. The arithmetic encoding block 518 is arranged to produce an output bitstream based on its inputs, for transmission from an output device such as a wired modem or wireless transceiver.

In operation, the encoder processes a speech input signal sampled at 16 kHz in frames of 20 milliseconds, with some of the processing done in subframes of 5 milliseconds. The output bitstream payload contains arithmetically encoded parameters, and has a bitrate that varies depending on a quality setting provided to the encoder and on the complexity and perceptual importance of the input signal.

The speech input signal is input to the high-pass filter 504 to remove frequencies below 80 Hz which contain almost no speech energy and may contain noise that can be detrimental to the coding efficiency and cause artifacts in the decoded output signal. The high-pass filter 504 is preferably a second order auto-regressive moving average (ARMA) filter.

The high-pass filtered input $x_{HP}$ is input to the linear prediction coding (LPC) analysis block 504, which calculates 16 LPC coefficients $a_i$ using the covariance method which minimizes the energy of the LPC residual $r_{LPC}$:

$$r_{LPC}(n) = x_{HP}(n) - \sum_{i=1}^{16} x_{HP}(n-i)a_i,$$

where n is the sample number. The LPC coefficients are used with an LPC analysis filter to create the LPC residual.

The LPC coefficients are transformed to a line spectral frequency (LSF) vector. The LSFs are quantized using the first vector quantizer 506, a multi-stage vector quantizer (MSVQ) with 10 stages, producing 10 LSF indices that together represent the quantized LSFs. The quantized LSFs are transformed back to produce the quantized LPC coefficients for use in the noise shaping quantizer 516.

The LPC residual is input to the open loop pitch analysis block 508, producing one pitch lag for every 5 millisecond subframe, i.e., four pitch lags per frame. The pitch lags are chosen between 32 and 288 samples, corresponding to pitch frequencies from 56 to 500 Hz, which covers the range found in typical speech signals. Also, the pitch analysis produces a pitch correlation value which is the normalized correlation of the signal in the current frame and the signal delayed by the pitch lag values. Frames for which the correlation value is below a threshold of 0.5 are classified as unvoiced, i.e., containing no periodic signal, whereas all other frames are classified as voiced. The pitch lags are input to the arithmetic coder 518 and noise shaping quantizer 516.

For voiced frames, a long-term prediction analysis is performed on the LPC residual. The LPC residual $r_{LPC}$ is supplied from the LPC analysis block 504 to the LTP analysis block 510. For each subframe, the LTP analysis block 510 solves normal equations to find 5 linear prediction filter coefficients $b_i$ such that the energy in the LTP residual $r_{LTP}$ for that subframe:

$$r_{LTP}(n) = r_{LPC}(n) - \sum_{i=-2}^{2} r_{LPC}(n - lag - i)b_i,$$

is minimized.

Thus, the LTP residual is computed as the LPC residual in the current subframe minus a filtered and delayed LPC residual. The LPC residual in the current subframe and the delayed LPC residual are both generated with an LPC analysis filter controlled by the same LPC coefficients. That means that when the LPC coefficients were updated, an LPC residual is computed not only for the current frame but also a new LPC residual is computed for at least lag+2 samples preceding the current frame.

The LTP coefficients for each frame are quantized using a vector quantizer (VQ). The resulting VQ codebook index is input to the arithmetic coder, and the quantized LTP coefficients $b_Q$ are input to the noise shaping quantizer.

The high-pass filtered input is analyzed by the noise shaping analysis block 514 to find filter coefficients and quantization gains used in the noise shaping quantizer. The filter coefficients determine the distribution over the quantization noise over the spectrum, and are chose such that the quantization is least audible. The quantization gains determine the step size of the residual quantizer and as such govern the balance between bitrate and quantization noise level.

All noise shaping parameters, including the filter coefficients discussed above, can be computed and applied per subframe of 5 milliseconds. First, a $16^{th}$ order noise shaping LPC analysis is performed on a windowed signal block of 16 milliseconds. The signal block has a look-ahead of 5 milliseconds relative to the current subframe, and the window is an asymmetric sine window. The noise shaping LPC analysis is done with the autocorrelation method. The quantization gain is found as the square-root of the residual energy from the noise shaping LPC analysis, multiplied by a constant to set the average bitrate to the desired level. For voiced frames, the quantization gain is further multiplied by 0.5 times the inverse of the pitch correlation determined by the pitch analyses, to reduce the level of quantization noise which is more easily audible for voiced signals. The quantization gain for each subframe is quantized, and the quantization indices are input to the arithmetically encoder 518. The quantized quantization gains are input to the noise shaping quantizer 516.

Next a set of short-term noise shaping coefficients $a_{shape,\,i}$ are found by applying bandwidth expansion to the coefficients found in the noise shaping LPC analysis. This bandwidth expansion moves the roots of the noise shaping LPC polynomial towards the origin, according to the formula:

$$a_{shape,\,i} = a_{autocorr,\,i}\, g^i$$

where $a_{autocorr,\,i}$ is the ith coefficient from the noise shaping LPC analysis and for the bandwidth expansion factor g a value of 0.94 was found to give good results.

For voiced frames, the noise shaping quantizer also applies long-term noise shaping. It uses three filter taps, described by:

$$b_{shape} = 0.5\ \mathrm{sqrt(PitchCorrelation)}\ [0.25, 0.5, 0.25].$$

The short-term and long-term noise shaping coefficients are input to the noise shaping quantizer 516.

A sparseness measure S is computed from the LPC residual signal. First ten energies of the LPC residual signals in the current frame are determined, one energy per block of 2 milliseconds $$E(k) = \sum_{n=1}^{32} r_{LPC}(32k+n)^2.$$

Then the sparseness measure is obtained as the absolute difference between logarithms of energies in consecutive blocks is added for the frame $$S = \sum_{k=1}^{9} \mathrm{abs}(\log(E(k)) - \log(E(k-1))).$$

The high-pass filtered input is also input to the noise shaping quantizer 516.

Figure 6:
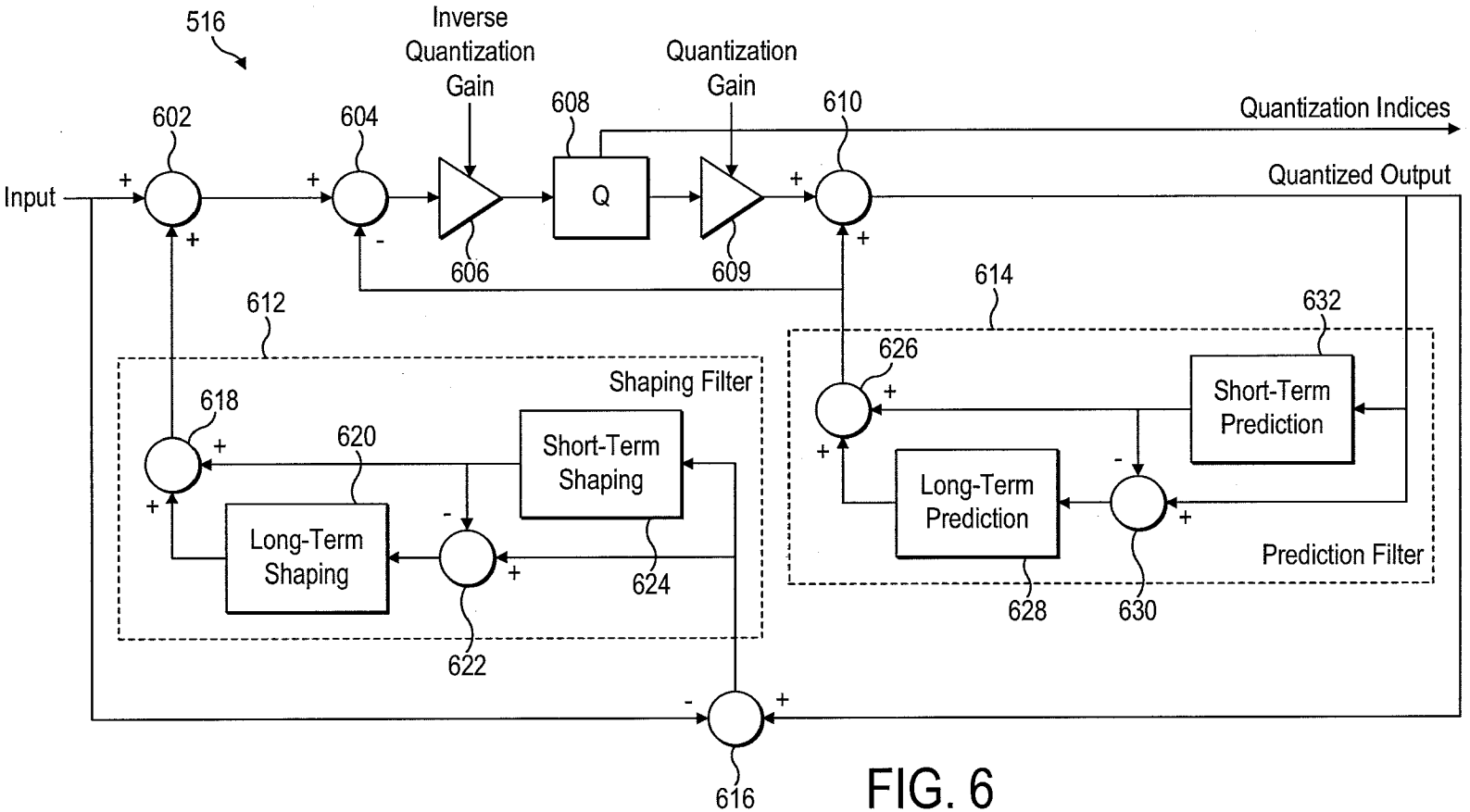
FIG. 6 is a schematic block diagram of a noise shaping quantizer.

An example of the noise shaping quantizer 516 is now discussed in relation to FIG. 6.

The noise shaping quantizer 516 comprises a first addition stage 602, a first subtraction stage 604, a first amplifier 606, a scalar quantizer 608, a second amplifier 609, a second addition stage 610, a shaping filter 612, a prediction filter 614 and a second subtraction stage 616. The shaping filter 612 comprises a third addition stage 618, a long-term shaping block 620, a third subtraction stage 622, and a short-term shaping block 624. The prediction filter 614 comprises a fourth addition stage 626, a long-term prediction block 628, a fourth subtraction stage 630, and a short-term prediction block 632.

The first addition stage 602 has an input arranged to receive the high-pass filtered input from the high-pass filter 502, and another input coupled to an output of the third addition stage 618. The first subtraction stage has inputs coupled to outputs of the first addition stage 602 and fourth addition stage 626. The first amplifier has a signal input coupled to an output of the first subtraction stage and an output coupled to an input of the scalar quantizer 608. The first amplifier 606 also has a control input coupled to the output of the noise shaping analysis block 514. The scalar quantiser 608 has outputs coupled to inputs of the second amplifier 609 and the arithmetic encoding block 518. The second amplifier 609 also has a control input coupled to the output of the noise shaping analysis block 514, and an output coupled to the an input of the second addition stage 610. The other input of the second addition stage 610 is coupled to an output of the fourth addition stage 626. An output of the second addition stage is coupled back to the input of the first addition stage 602, and to an input of the short-term prediction block 632 and the fourth subtraction stage 630. An output of the short-tem prediction block 632 is coupled to the other input of the fourth subtraction stage 630. The fourth addition stage 626 has inputs coupled to outputs of the long-term prediction block 628 and short-term prediction block 632. The output of the second addition stage 610 is further coupled to an input of the second subtraction stage 616, and the other input of the second subtraction stage 616 is coupled to the input from the high-pass filter 502. An output of the second subtraction stage 616 is coupled to inputs of the short-term shaping block 624 and the third subtraction stage 622. An output of the short-tem shaping block 624 is coupled to the other input of the third subtraction stage 622. The third addition stage 618 has inputs coupled to outputs of the long-term shaping block 620 and short-term prediction block 624.

The purpose of the noise shaping quantizer 516 is to quantize the LTP residual signal in a manner that weights the distortion noise created by the quantisation into parts of the frequency spectrum where the human ear is more tolerant to noise.

In operation, all gains and filter coefficients and gains are updated for every subframe, except for the LPC coefficients, which are updated once per frame. The noise shaping quantizer 516 generates a quantized output signal that is identical to the output signal ultimately generated in the decoder. The input signal is subtracted from this quantized output signal at the second subtraction stage 616 to obtain the quantization error signal d(n). The quantization error signal is input to a shaping filter 612, described in detail later. The output of the shaping filter 612 is added to the input signal at the first addition stage 602 in order to effect the spectral shaping of the quantization noise. From the resulting signal, the output of the prediction filter 614, described in detail below, is subtracted at the first subtraction stage 604 to create a residual signal. The residual signal is multiplied at the first amplifier 606 by the inverse quantized quantization gain from the noise shaping analysis block 514, and input to the scalar quantizer 608. The quantization indices of the scalar quantizer 608 represent an excitation signal that is input to the arithmetically encoder 518. The scalar quantizer 608 also outputs a quantization signal, which is multiplied at the second amplifier 609 by the quantized quantization gain from the noise shaping analysis block 514 to create an excitation signal. The output of the prediction filter 614 is added at the second addition stage to the excitation signal to form the quantized output signal. The quantized output signal is input to the prediction filter 614.

On a point of terminology, note that there is a small difference between the terms "residual" and "excitation". A residual is obtained by subtracting a prediction from the input speech signal. An excitation is based on only the quantizer output. Often, the residual is simply the quantizer input and the excitation is its output.

The shaping filter 612 inputs the quantization error signal d(n) to a short-term shaping filter 624, which uses the short-term shaping coefficients $a_{shape,i}$ to create a short-term shaping signal $s_{short}(n)$, according to the formula:

$$s_{short}(n) = \sum_{i=1}^{16} d(n-i)a_{shape,i}.$$

The short-term shaping signal is subtracted at the third addition stage 622 from the quantization error signal to create a shaping residual signal f(n). The shaping residual signal is input to a long-term shaping filter 620 which uses the long-term shaping coefficients $b_{shape,i}$ to create a long-term shaping signal $s_{long}(n)$, according to the formula:

$$s_{long}(n) = \sum_{i=-2}^{2} f(n-lag-i)b_{shape,i}.$$

The short-term and long-term shaping signals are added together at the third addition stage 618 to create the shaping filter output signal.

The prediction filter 614 inputs the quantized output signal y(n) to a short-term prediction filter 632, which uses the quantized LPC coefficients $a_i$ to create a short-term prediction signal $p_{short}(n)$, according to the formula:

$$p_{short}(n) = \sum_{i=1}^{16} y(n-i)a_i.$$

The short-term prediction signal is subtracted at the fourth subtraction stage 630 from the quantized output signal to create an LPC excitation signal $e_{LPC}(n)$. The LPC excitation signal is input to a long-term prediction filter 628 which uses the quantized long-term prediction coefficients $b_i$ to create a long-term prediction signal $p_{long}(n)$, according to the formula:

$$p_{long}(n) = \sum_{i=-2}^{2} e_{LPC}(n-lag-i)b_i.$$

The short-term and long-term prediction signals are added together at the fourth addition stage 626 to create the prediction filter output signal.

The LSF indices, LTP indices, quantization gains indices pitch lags and are each arithmetically encoded and multiplexed by the arithmetic encoder 518 to create the payload bitstream. The arithmetic encoder 518 uses a look-up table with probability values for each index. The look-up tables are created by running a database of speech training signals and measuring frequencies of each of the index values. The frequencies are translated into probabilities through a normalization step. The excitation quantization indices are encoded in the arithmetic encoder 518 using the technique described above with reference to FIG. 3.

Figure 7:
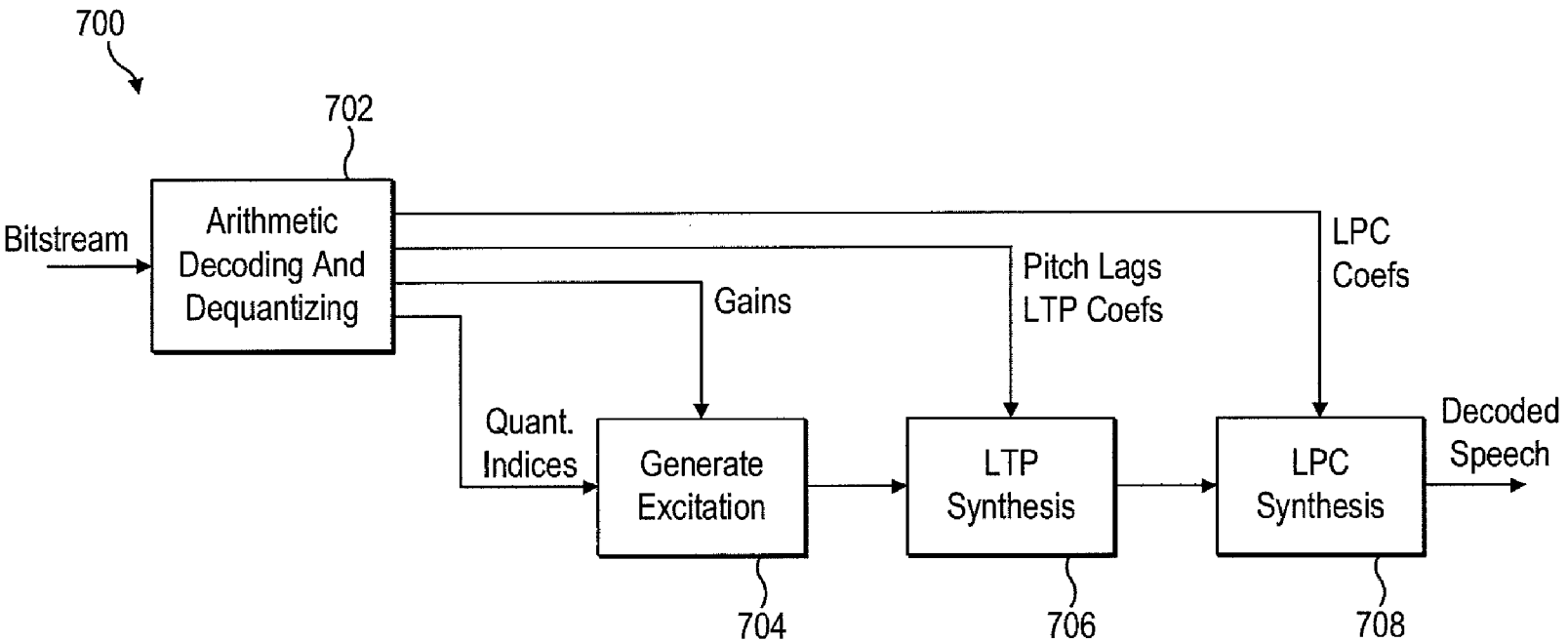
FIG. 7 is a schematic block diagram of a decoder.

An example decoder 700 for use in decoding a signal encoded according to embodiments of the present invention is now described in relation to FIG. 7.

The decoder 700 comprises an arithmetic decoding and dequantizing block 702, an excitation generation block 704, an LTP synthesis filter 706, and an LPC synthesis filter 708. The arithmetic decoding and dequantizing block 702 has an input arranged to receive an encoded bitstream from an input device such as a wired modem or wireless transceiver, and has outputs coupled to inputs of each of the excitation generation block 704, LTP synthesis filter 706 and LPC synthesis filter 708. The excitation generation block 704 has an output coupled to an input of the LTP synthesis filter 706, and the LTP synthesis block 706 has an output connected to an input of the LPC synthesis filter 708. The LPC synthesis filter has an output arranged to provide a decoded output for supply to an output device such as a speaker or headphones.

At the arithmetic decoding and dequantizing block 702, the arithmetically encoded bitstream is demultiplexed and decoded to create LSF indices, LTP indices and LTP indices, quantization gains indices and pitch lags.

The decoding block 702 decodes a frame of 320 excitation quantization indices, in 20 blocks of 16 quantization indices each. Each block is sequentially and independently decoded.

For each block, a radius K, representing the sum of absolute values of quantization indices in that block, is arithmetically decoded using a fixed, prestored table of probability values.

Next, the distribution of absolute values over the block is reconstructed by recursively splitting the entropy coded bitstream representing a parent block into two equal-sized subblocks, starting with the block of 16 absolute values, and decoding the distribution of summed absolute values over the two subblocks. For each split, a probability table P is selected based on the length of the parent block and the sum of absolute values $k_{parent}$ in the parent block. The probability table P stores the probability of having a sum of absolute values $k_{sub}$, 0 in the first subblock (block 0), for values of $k_{sub}$, 0 from 0 to $k_{parent}$. The sum of absolute values in the first subblock is arithmetically decoded using the selected probability table. The sum of absolute values in the second subblock is computed as $$K_{sub},1=k_{parent}-k_{sub},0.$$

Whenever a subblock is encountered for which the sum of absolute values is zero, the absolute values in that subblock are set to zero without further arithmetic decoding. After decoding the block for each nonzero absolute value in the block, the sign value s(n) is arithmetically decoded using a table of probability values and multiplied with the absolute value u(n) to produce the quantization index. In pseudo code, this procedure can be expressed as

```
Init: k0 = K;
for m = 0...3
    for i = 1 ... 2^m
        if k_parent > 0
            Select a probability table P = Table{m}{k_m(i − 1)};
            Arithmetically decode k_sub using table P;
            k_m+1(2i − 2) = k_sub;
            k_m+1(2i − 1) = k_m(i − 1) − k_sub;
        else
            k_m+1(2i − 2) = 0;
            k_m+1(2i − 1) = 0;
        end
    end
end
for n = 0...15
    u(n) = k4(n);
    if u(n) > 0
        Arithmetically decode s(n)
        q(n) = u(n)s(n);
    else
        q(n) = 0;
    end
end
```

The quantized quantization gains, one for each subframe of 5 milliseconds, are multiplied by the quantization indices q(n) to produce the excitation signals e(n).

The LSF indices are converted to quantized LSFs by adding the codebook vectors of the ten stages of the MSVQ. The quantized LSFs are transformed to quantized LPC coefficients. The LTP indices and gains indices are converted to quantized LTP coefficients and quantization gains, through look ups in the quantization codebooks.

At the excitation generation block, the excitation quantization indices signal is multiplied by the quantization gain to create an excitation signal e(n).

The excitation signal is input to the LTP synthesis filter 706 to create the LPC excitation signal $e_{LPC}(n)$ according to:

$$e_{LPC}(n) = e(n) + \sum_{i=-2}^{2} e(n - lag - i)b_i,$$

using the pitch lag and quantized LTP coefficients $b_i$.

The LPC excitation signal is input to the LPC synthesis filter to create the decoded speech signal y(n) according to:

$$y(n) = e_{LPC}(n) + \sum_{i=1}^{16} e_{LPC}(n - i)a_i,$$

using the quantized LPC coefficients $a_i$.

The encoder 500 and decoder 700 are preferably implemented in software, such that each of the components 502 to 632 and 702 to 708 comprise modules of software stored on one or more memory devices and executed on a processor. A preferred application of the present invention is to encode speech for transmission over a packet-based network such as the Internet, preferably using a peer-to-peer (P2P) network implemented over the Internet, for example as part of a live call such as a Voice over IP (VoIP) call. In this case, the encoder 500 and decoder 700 are preferably implemented in client application software executed on end-user terminals of two users communicating over the P2P system.

It will be appreciated that the above embodiments are described only by way of example. Other applications and configurations may be apparent to the person skilled in the art given the disclosure herein. The scope of the invention is not limited by the described embodiments, but only by the following claims.

The invention claimed is:

1. A method for encoding speech according to a source filter model, whereby speech is modelled to comprise a source signal filtered by a time varying filter, the method comprising:

receiving, using a computing device, a speech signal;

deriving, using the computing device, from the speech signal a frame of excitation quantization indices, each index being represented by a value and the frame comprising a plurality of blocks; and encoding, using the computing device, one or more parent blocks of values, the number of values being the length of each block, the method comprising for each parent block:

(a) determining a first sum of values in the parent block;

(b) splitting the parent block into smaller subblocks;

(c) for at least one of the subblocks, determining a second sum of the values in the subblock, selecting a likelihood table from the plurality of likelihood tables based on said first sum of values in the parent block and encoding the second sum using the likelihood table;

(d) designating each subblock a parent block;

(e) carrying out steps (a), (b), (c) and (d) until at least one parent block reaches a predetermined condition.

2. The method of claim 1, wherein the likelihood table is selected based on also the length of the parent block.

3. The method of claim 1, wherein said splitting comprises splitting the parent block into smaller subblocks of equal size.

4. The method of claim 1, wherein said encoding comprises entropy encoding.

5. The method of claim 1, wherein said encoding comprises arithmetic encoding.

6. The method of claim 1, wherein said predetermined condition is that all subblocks have a length of one.

7. The method of claim 1, wherein said predetermined condition is that the sum of the values in the first subblock equals zero.

8. The method of claim 1, wherein said determining comprises using a known value for the first sum.

9. The method of claim 1, wherein said determining comprises determining a sum of the values of summation.

10. The method of claim 1 further comprising storing an encoded result of step (b), and each step (d) until a final result is generated after the final splitting and encoding step for the block.

11. A system for encoding speech according to a source filter model, whereby speech is modelled to comprise a source signal filtered by a time varying filter, the system comprising:

means for receiving a speech signal:

means for deriving from the speech signal a frame of excitation quantization indices, each index being represented by a value and the frame comprising a plurality of blocks; and an encoder stored on a hardware storage device comprising:

means for splitting the parent block into smaller subblocks;

means for summing the values in a subblock to generate a sum;

a store holding likelihood tables, each likelihood table holding for each possible sum of values a probability associated with that sum;

means for encoding the sum of the values in the subblock using a likelihood table located in the store;

means for selecting from the store of likelihood tables a table based on the sum of the parent subblock, said encoding means being arranged to encode the sum of a subblock split from the parent block based on the selected likelihood table; and storage means for holding the result of said encoding.

12. The system of claim 11, wherein said means for selecting comprises means for selecting the table based also on the length of the parent block.

13. The system of claim 11, wherein said means for splitting comprises means for splitting the parent block into smaller subblocks of equal size.

14. The system of claim 11, wherein said means for encoding comprises means for entropy encoding.

15. The system of claim 11, wherein said means for encoding comprises means for arithmetic encoding.

16. A system for decoding speech according to a source filter model, whereby speech is modelled to comprise a source signal filtered by a time varying filter, the system comprising:

means for receiving an encoded speech signal including a frame of excitation quantization indices, each index being represented by a value and the frame comprising a plurality of blocks; and a decoder stored on a hardware storage device comprising:

means for obtaining a first sum of value in the parent block;

means for splitting a parent block into smaller subblocks;

means for selecting a likelihood table from a plurality of stored tables based on the first sum of the values in the parent block, each likelihood table holding for each possible second sum of values in the subblock a probability associated with that sum; and means for decoding the bitstream based on the likelihood table to generate the second sum of values for the subblock.

* * * * *